US011596959B1

(12) United States Patent
Hung

(10) Patent No.: US 11,596,959 B1
(45) Date of Patent: Mar. 7, 2023

(54) FLOW GUIDE DEVICE OF SPRAY CONTAINER

(71) Applicant: YU CHUANG ESTHETICS CONSULTANT CO., LTD., New Taipei (TW)

(72) Inventor: Ching Sen Hung, New Taipei (TW)

(73) Assignee: YU CHUANG ESTHETICS CONSULTANT CO., LTD., New Taipei (TW)

( * ) Notice: Subject to any disclaimer, the term of this patent is extended or adjusted under 35 U.S.C. 154(b) by 0 days.

(21) Appl. No.: 17/402,585

(22) Filed: Aug. 15, 2021

(51) Int. Cl.
*B65D 83/14* (2006.01)
*B05B 11/00* (2006.01)
*B05B 15/30* (2018.01)

(52) U.S. Cl.
CPC ..... *B05B 11/0059* (2013.01); *B05B 15/30* (2018.02)

(58) Field of Classification Search
CPC ..... B65D 83/36; B65D 83/32; B65D 83/48; B05B 11/0059; B05B 15/30
See application file for complete search history.

(56) References Cited

U.S. PATENT DOCUMENTS 4,371,098 A * 2/1983 Nozawa ..... B05B 11/0059 137/853
4,572,406 A * 2/1986 Pratt ..... B65D 83/32 222/464.2
4,775,079 A * 10/1988 Grothoff ..... B05B 11/0059 222/402.19
5,222,636 A * 6/1993 Meuresch ..... B05B 11/0059 222/402.19
5,979,712 A * 11/1999 Montaner ..... B05B 11/0059 222/402.19
6,186,372 B1 * 2/2001 Garcia ..... B05B 11/0059 222/402.19

FOREIGN PATENT DOCUMENTS

EP 0968767 A1 * 1/2000 ..... B05B 11/0059

* cited by examiner

*Primary Examiner* — Bob Zadeh
(74) *Attorney, Agent, or Firm* — Raymond Chan

(57) ABSTRACT

A flow guide device of a spray container which comprises a bottle, a nozzle having a flow guide pipe and a straw is configured to be connected between the flow guide pipe and a suction pipe. The flow guide device includes a connecting pipe, a check valve and a check ball. The connecting pipe is connected with the flow guide pipe, which has a plurality of back flow passages and forward flow passages formed on the inner edge thereof. The check valve is arranged between the connecting pipe and the flow guiding pipe. The check ball is arranged in the connecting pipe and located on the port of the straw. When the spray container is in an inverted state, the liquid enters the connecting pipe, the one-way valve and the flow guide pipe from the backflow channel, and the check valve, wherein the flow guide pipe through the back flow passages is finally sprayed out. Accordingly, the flow guiding device has a simple structure and is convenient to assemble and capable of reducing the overall manufacturing costs.

3 Claims, 10 Drawing Sheets

FLOW GUIDE DEVICE OF SPRAY CONTAINER

BACKGROUND OF THE PRESENT INVENTION

Field of Invention

The present invention relates to a flow guide device of spray container and, more particularly, to a flow guide device utilizing a check valve to control the liquid to flow unidirectionally, so as to be capable of guiding and spraying out the liquid even if the spray container is in an inverted state.

Description of Related Arts

Spray containers are common items in daily life, such as the sprayers for toning lotion or anti-mosquito liquid. Besides, in order to enable the liquid to be sprayed at different angles, especially when the spray container is inverted, the flow guide path of the spray container needs to have a different design. For example, inventions, Taiwan Application No. 102217887 "Flow Guide Device for Spray Container", Patent No. M459031 "Improved Two-way Check Valve", and PCT Publication No. WO 99/29586 "Injector Usable in Both Erected and Inverted State", all have backflow design for inverted spraying. However, the technical disclosures in the aforementioned cases have relatively complicated designs in their component structures, rendering not only cumbersome and inconvenient in assembling, but also increase of manufacturing costs. Therefore, there are drawbacks of relatively high construction complexity and relatively high manufacturing cost in conventional technologies.

SUMMARY OF THE PRESENT INVENTION

Hence, an object of the present invention is to provide a flow guide device of spray container having a relatively simple structure.

Accordingly, the present invention provides a flow guide device of spray container. The spray container comprises a bottle adapted for containing liquid, a nozzle assembled on the bottle, and a straw, wherein the nozzle has a press portion and a flow guide pipe extended downwards from the press portion into the bottle. The flow guide device is assembled and connected between the flow guide pipe and the straw, so as for guiding the liquid in the bottle to be sprayed out from the nozzle. The flow guide device comprises a connecting pipe, a check valve and a check ball. The connecting pipe is adapted for connecting the flow guide pipe with the straw and has an upper pipe section, a middle pipe section and a lower pipe section. The upper pipe section is connected with the upper part of the flow guide pipe and has a plurality of back flow passages formed on the inner edge thereof for the liquid in said bottle to flow into the middle pipe section. The lower pipe section is connected with the straw and has a plurality of forward flow passages formed on the inner edge thereof. The check valve is assembled and arranged in the middle pipe section, so as to allow the liquid entering the middle pipe section from the back flow passages to unidirectionally pass therethrough to enter the flow guide pipe. The check ball is assembled and arranged in the lower pipe section and at the port of the straw, so as for timely preventing the liquid from back flowing into the straw or flowing from the middle pipe section into the lower pipe section. When the spray container is in an upright state and the press portion is pressed, the liquid in the bottle through the straw pushes the check ball away to enter the middle pipe section through the forward flow passages and be guided out from the bottle through the flow guide pipe. When the spray container is in an inverted state, the liquid in the bottle enters the middle pipe section through the back flow passages and passes through the check valve to flow through the flow guide pipe to be sprayed out from the nozzle, wherein in this state, the check ball is blocked at the end of the lower pipe section away from the straw, so as to prevent liquid from entering the lower pipe section. Because the flow guiding device is mainly formed through combining the connecting pipe, the check valve and the check ball, the device is simple in structure, convenient to assemble, and capable of further reducing the overall manufacturing costs.

DETAILED DESCRIPTION OF THE PREFERRED EMBODIMENT

Figure 1:
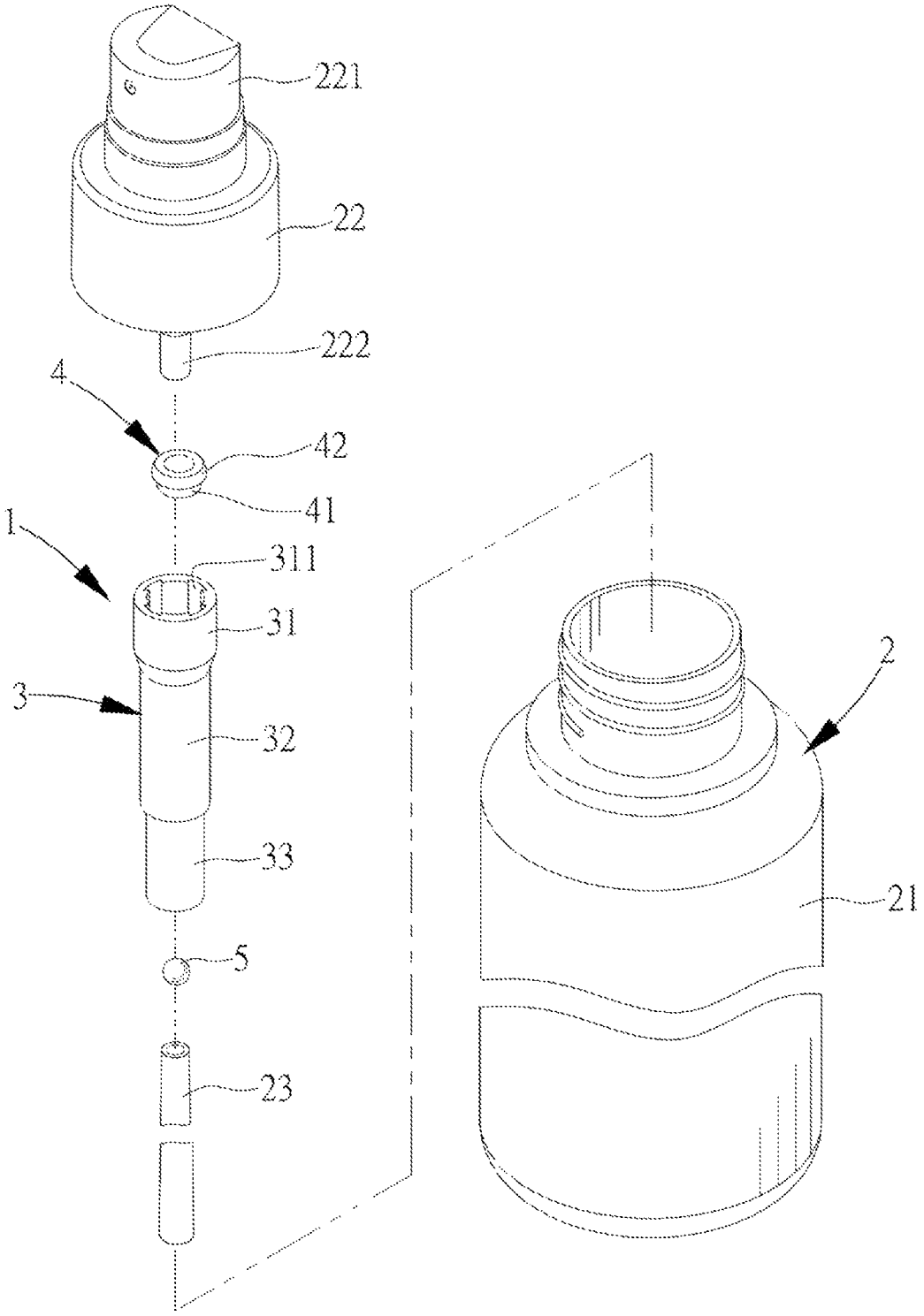
FIG. 1 is an exploded view of a spray container and a flow guide device according to a first preferred embodiment of the present invention.

Referring to FIGS. 1-6, a flow guide device 1 and a spray container 2 according to a first preferred embodiment of the present invention are capable of being utilized together. The spray container 2 comprises a bottle 21 capable of containing liquid, a nozzle 22 disposed on the bottle 21, and a straw 23, wherein the nozzle 22 has a press portion 221 and a flow guide pipe 222 extended downwardly from the press portion 221 into the bottle 21. Because the press portion 221 has a conventional structure that is not characteristic subject matter of the present invention, it is not be described in detail herein. The flow guiding pipe 222 comprises an upper assembling section 223 connected with the press section 221, an engaging section 224 extended downwardly from the upper assembling section 223, and a lower assembling section 225 extended downwardly from the engaging section 224.

The flow guiding device 1 is arranged between the flow guiding pipe 222 and the straw 23 and utilized for guiding the liquid in the bottle 21 to be sprayed out from the nozzle 22. The flow guiding device 1 comprises a connecting pipe 3, a check valve 4 and a check ball 5. The connecting pipe 3 has an upper pipe section 31, a middle pipe section 32 and a lower pipe section 33, wherein the upper pipe section 31 is connected and assembled with the upper assembling section 223 of the flow guide pipe 222 and is close to the press portion 221 and the inner edge thereof forms a plurality of back flow passages 311 so as for the liquid in the bottle 21 to flow into the middle pipe section. The middle pipe section 32 is adapted for the engaging section 224 and the lower assembling section 225 to pass through and arranged therein, wherein the lower pipe section 33 is connected with the straw 23 and the inner edge thereof forms a plurality of forward flow passages 331.

The check valve 4 is arranged in the middle pipe section 32 and has a collar 41 sleeved on the lower assembling section 225 and a ring wing 42 expandingly formed from the surround of the collar 41, wherein the ring wing 42 is in contact with the middle pipe section 32 and the collar 41 and the ring wing 42 are adapted to stop the liquid flowing through the forward flow passages 331, but allowing the liquid flowing through the back flow passages 311 into the middle pipe section 32 to unidirectionally pass through. More specifically, the liquid passing through the back flow passages 311 can move the ring wing 42 away from the middle pipe section 32, so as to allow the liquid to pass through and enter the lower assembling section 225 of the flow guide pipe 222.

The check ball 5 is assembled and arranged in the lower pipe section 33 and at the port of the straw 23, so as for timely preventing the liquid from back flowing into the straw 23 or flowing from the middle pipe section 32 into the lower pipe section 33.

Figure 2:
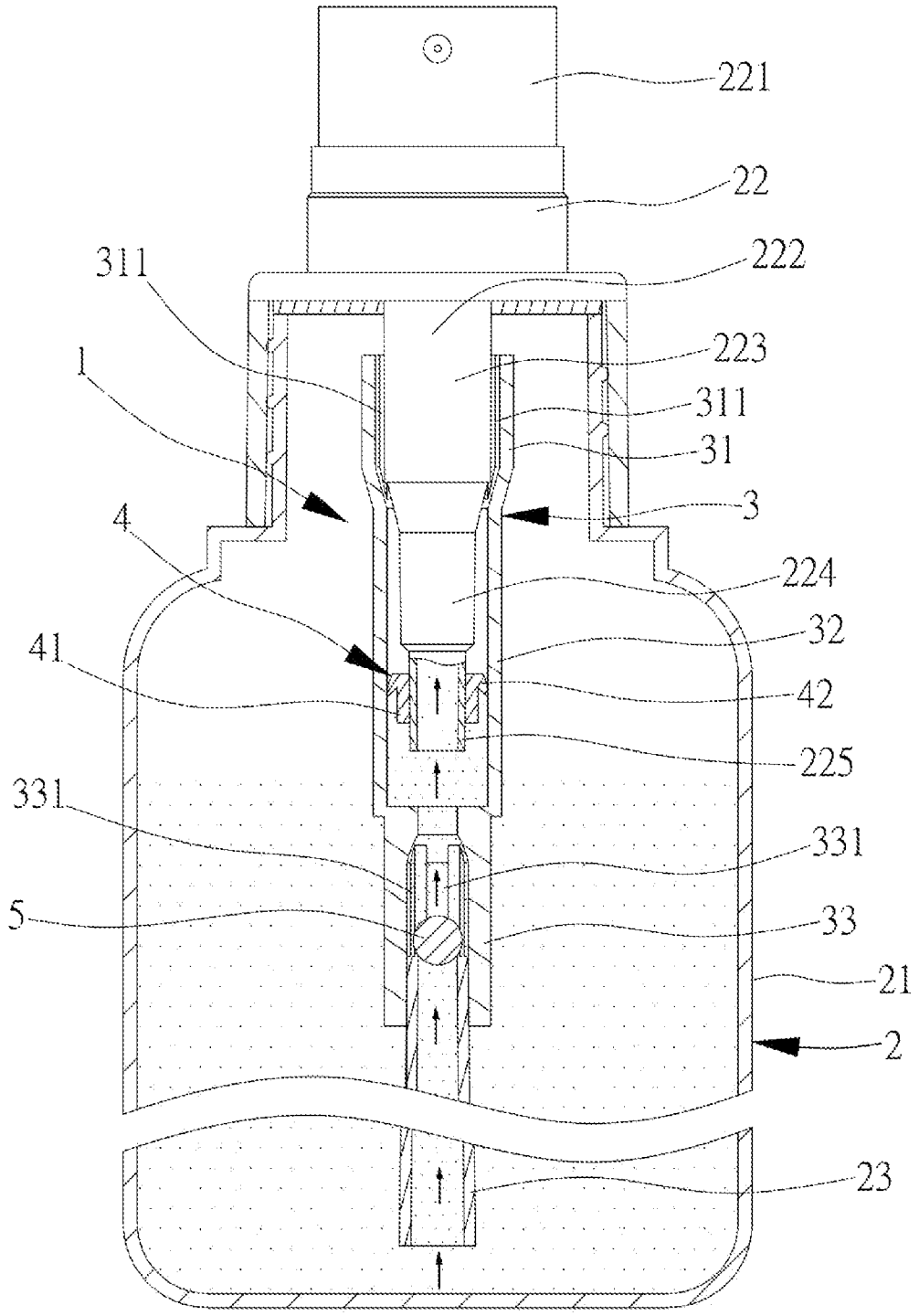
FIG. 2 is a section view of the assembly of the spray container and the flow guide device according to the above first preferred embodiment of the present invention.
Figure 3:
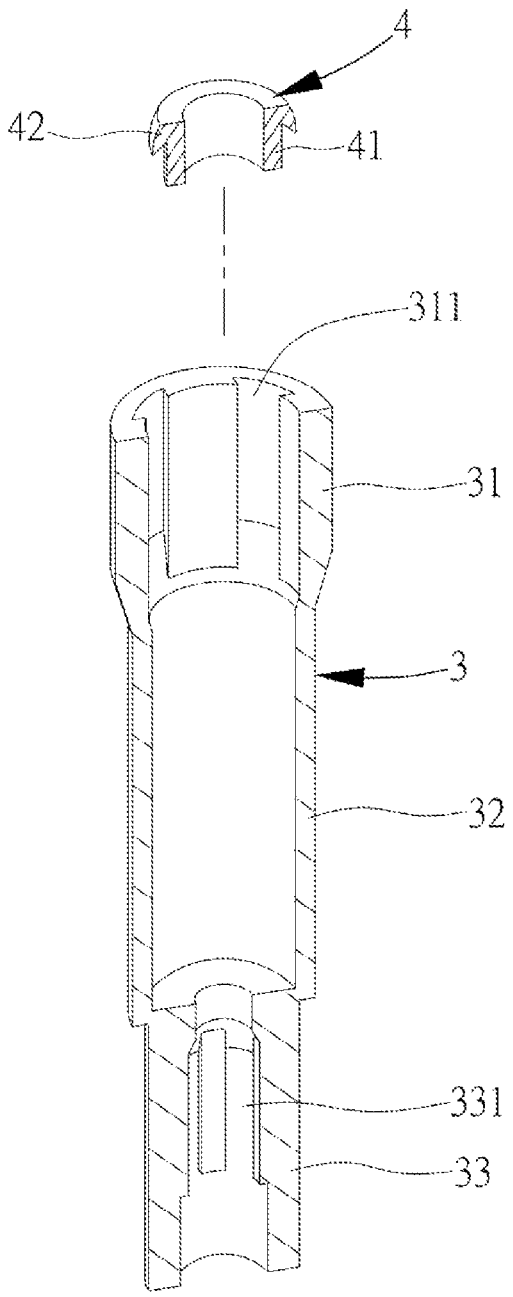
FIG. 3 is a sectional view of part of the flow guide device according to the above first preferred embodiment of the present invention.
Figure 4:
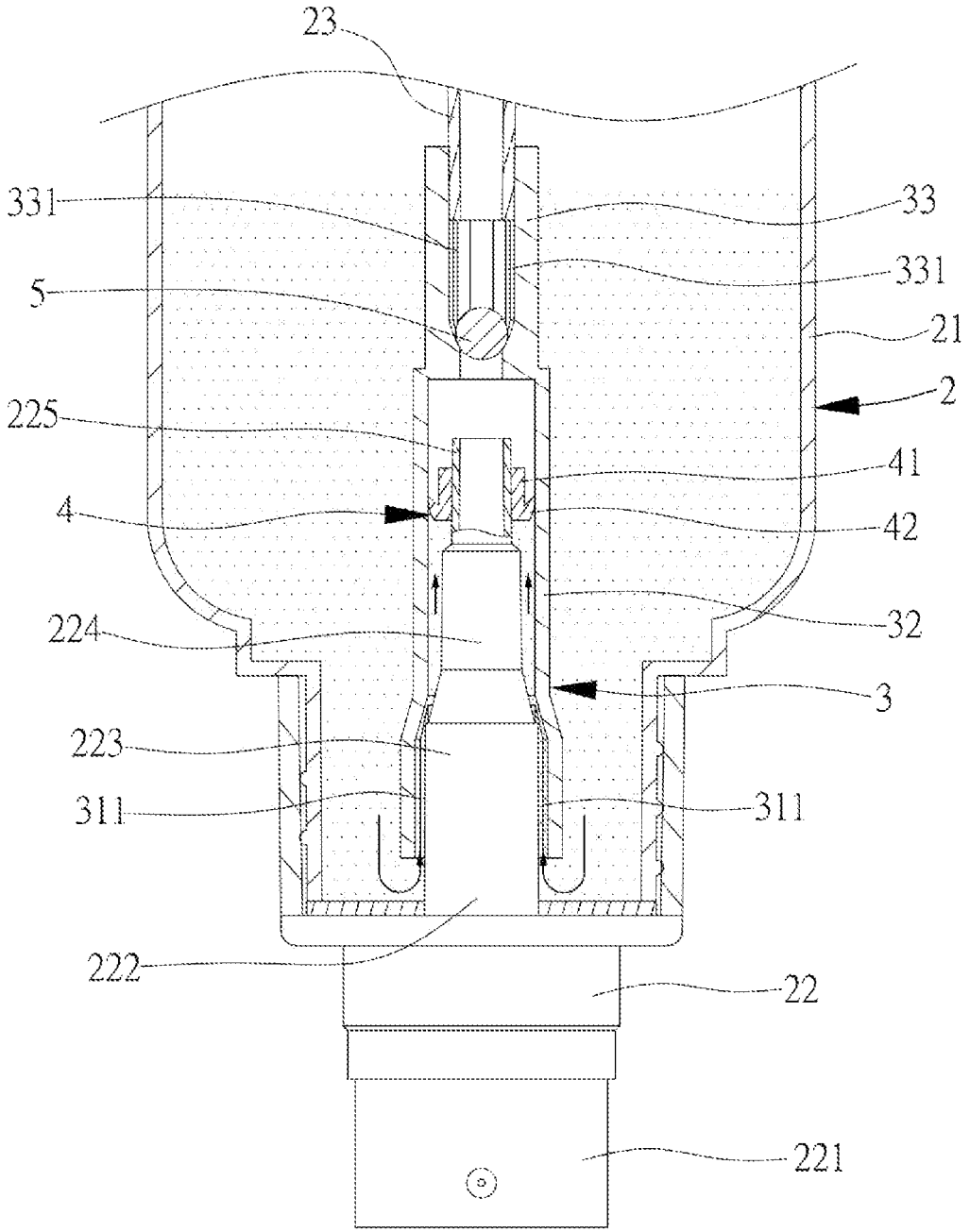
FIG. 4 is a section view of part the assembly of the spray container and the flow guide device in an inverted state according to the above first preferred embodiment of the present invention.
Figure 5:
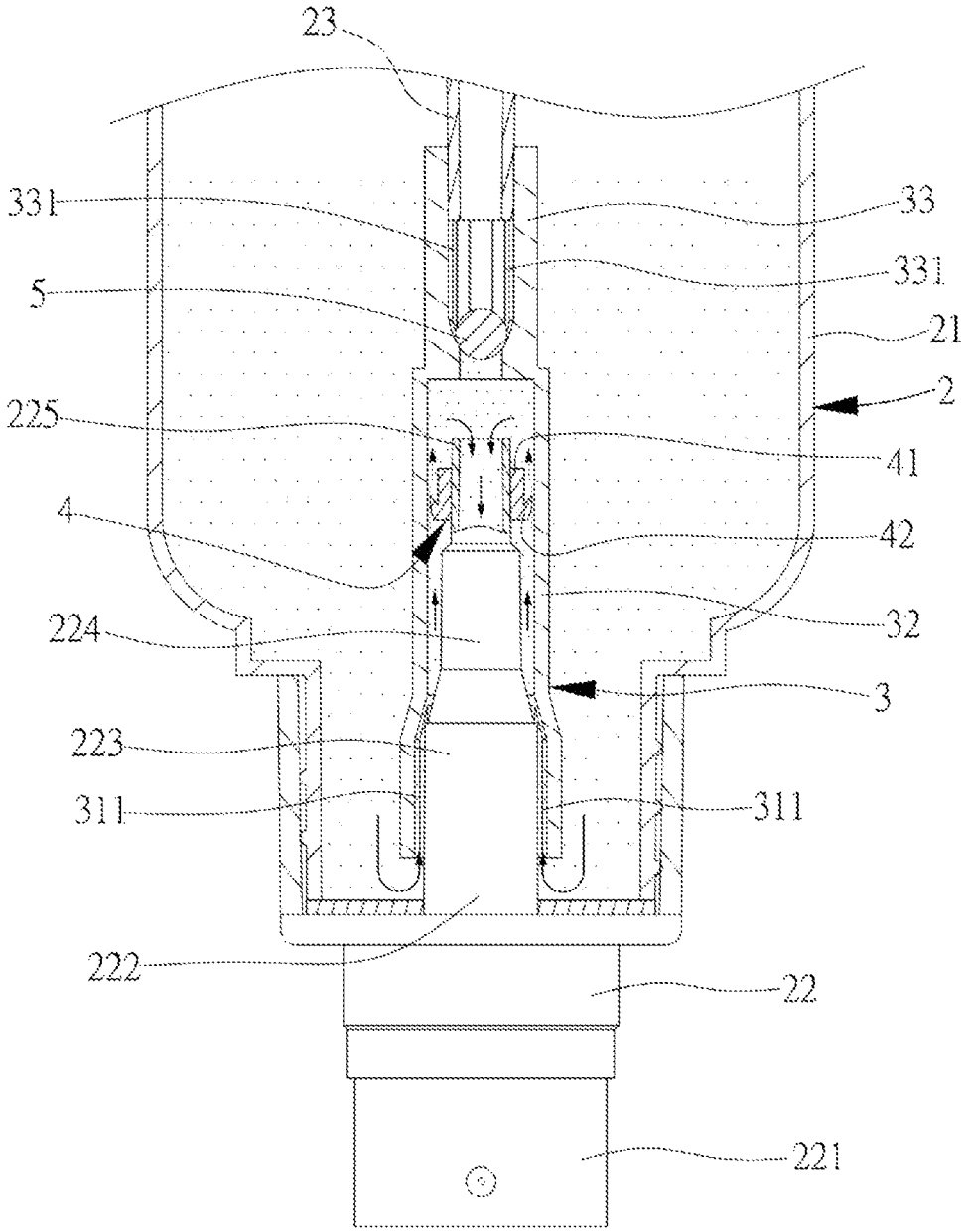
FIG. 5 is a perspective view illustrating liquid flow of FIG. 4.
Figure 6:
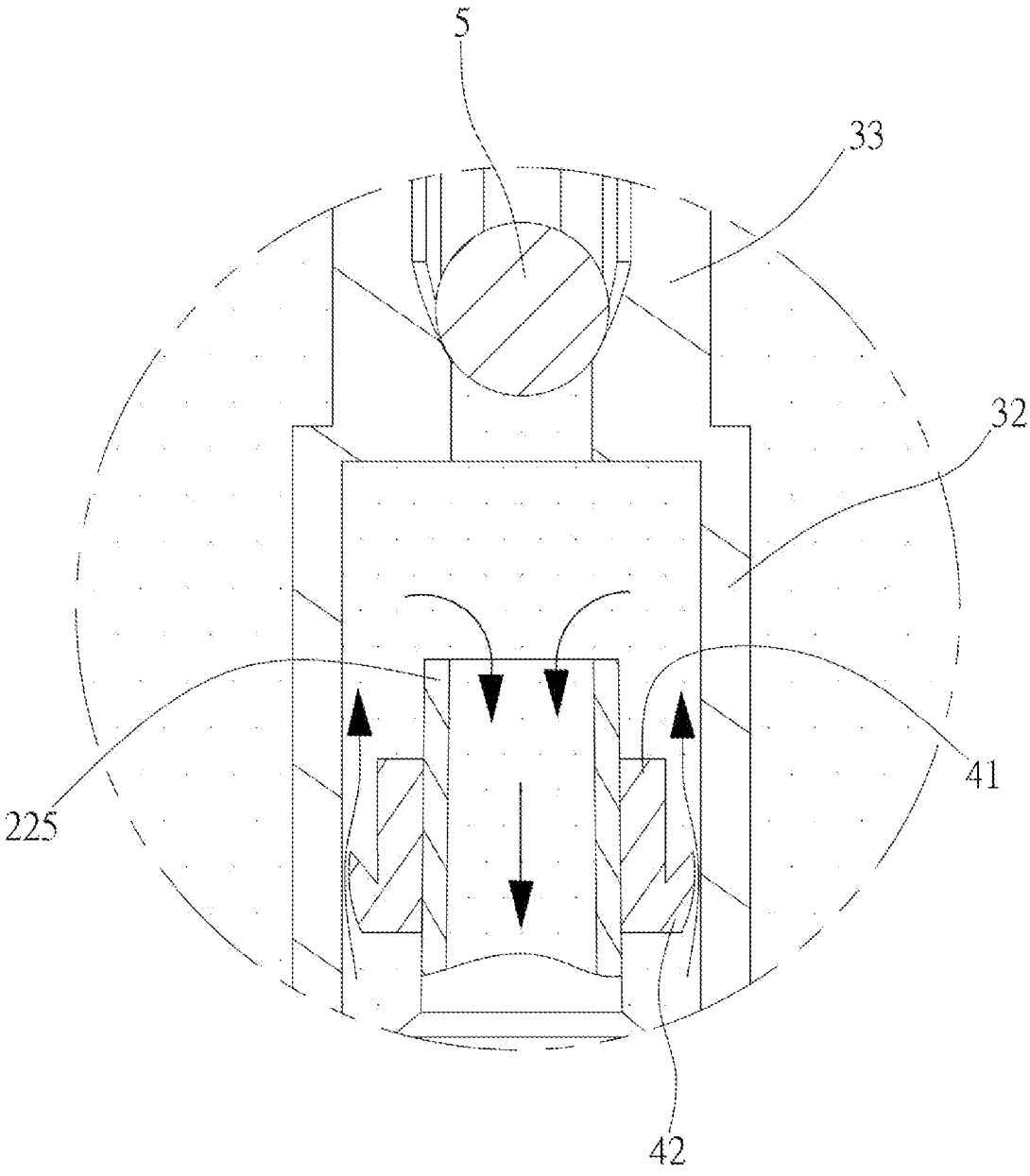
FIG. 6 is a partially enlarged view of FIG. 5.

Under a normal usage condition, in other words, having the spray container 2 in an upright state, when the press portion 221 is pressed, the liquid in the bottle 21 pushes the check ball 5 away via the straw 23 and enters the middle pipe section 32 through the forward flow passages 331. Since this is a general flow path of the liquid in the spray container 2, the state of the liquid removing the check ball 5 is not illustrated in the figures. Here, the liquid in the middle pipe section 32 is blocked by the check valve 4 and is limited only in the lower portion of the middle pipe section 32, as illustrated in FIG. 2. Then, it passes the lower assembling section 225, the engaging section 224 and the upper assembling section 223 of the flow guide pipe 222 to be guided to the outside of the bottle 21. When the spray container 2 is in an inverted state, as illustrated in FIG. 4, and the press portion 221 is pressed, the liquid in the bottle 21 enters the middle pipe section 32 through the back flow passages 311 and, as illustrated in FIGS. 5 and 6, pushes the ring wing 42 of the check valve 4 to move, so as to create a gap between the ring wing 42 and the middle pipe section 32. After the liquid passes through the check valve 4 and flow from the lower assembling section 225 of the flow guide pipe 222 to be finally ejected by the nozzle 22, the check ball 5, at the same time, is blocked at the end of the lower pipe section 33 away from the straw 23 to prevent a small amount of liquid and air in the middle pipe section 32 from entering the lower pipe section 33.

The flow guiding device 1 of a spray container 2 according to the present invention is mainly composed of the connecting pipe 3, the check valve 4 and the check ball 5, which provides a really simple structure that it is easy to be assembled and its overall manufacturing costs can further be reduced. It is worth mentioning that, based on the design that the upper pipe section 31 of the connecting pipe 3 is close to the press portion 221, when the spray container 2 is set in an inverted state, as illustrated in FIG. 5, even with only a small amount of liquid in the bottle 21, it can still be drawn to be ejected by the nozzle 22 easily, which provides a better convenience when being utilized in an inverted state.

Figure 7:
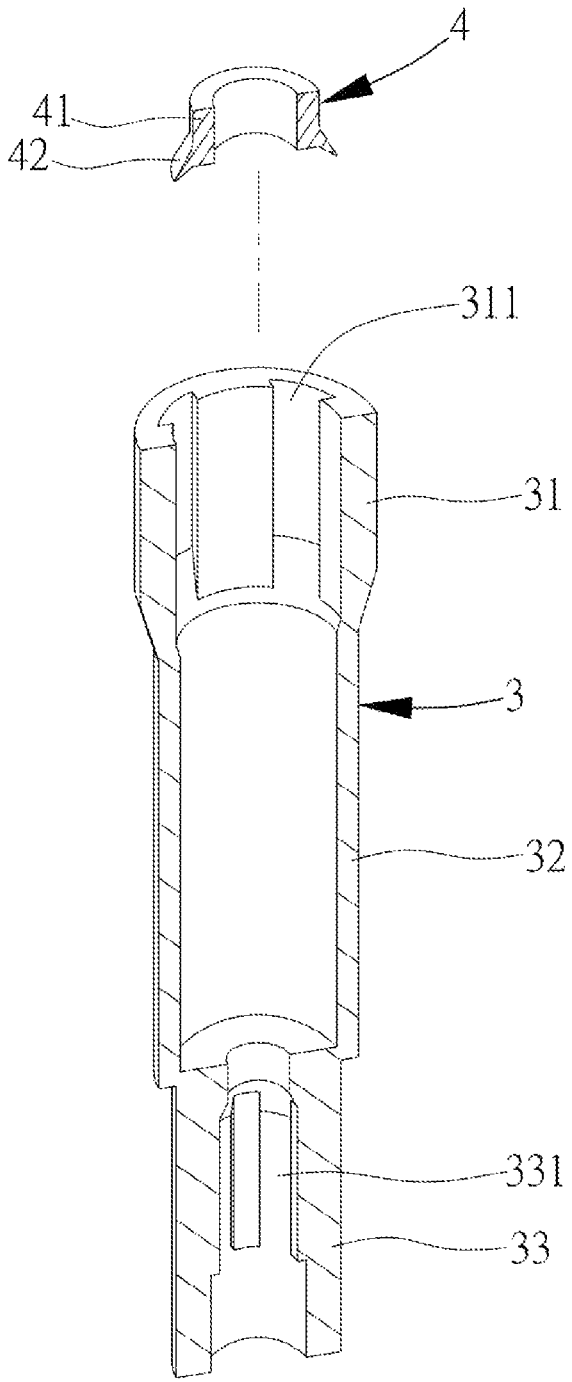
FIG. 7 is a sectional view of part of a check valve and a flow guide pipe of the flow guide device according to a second preferred embodiment of the present invention.
Figure 8:
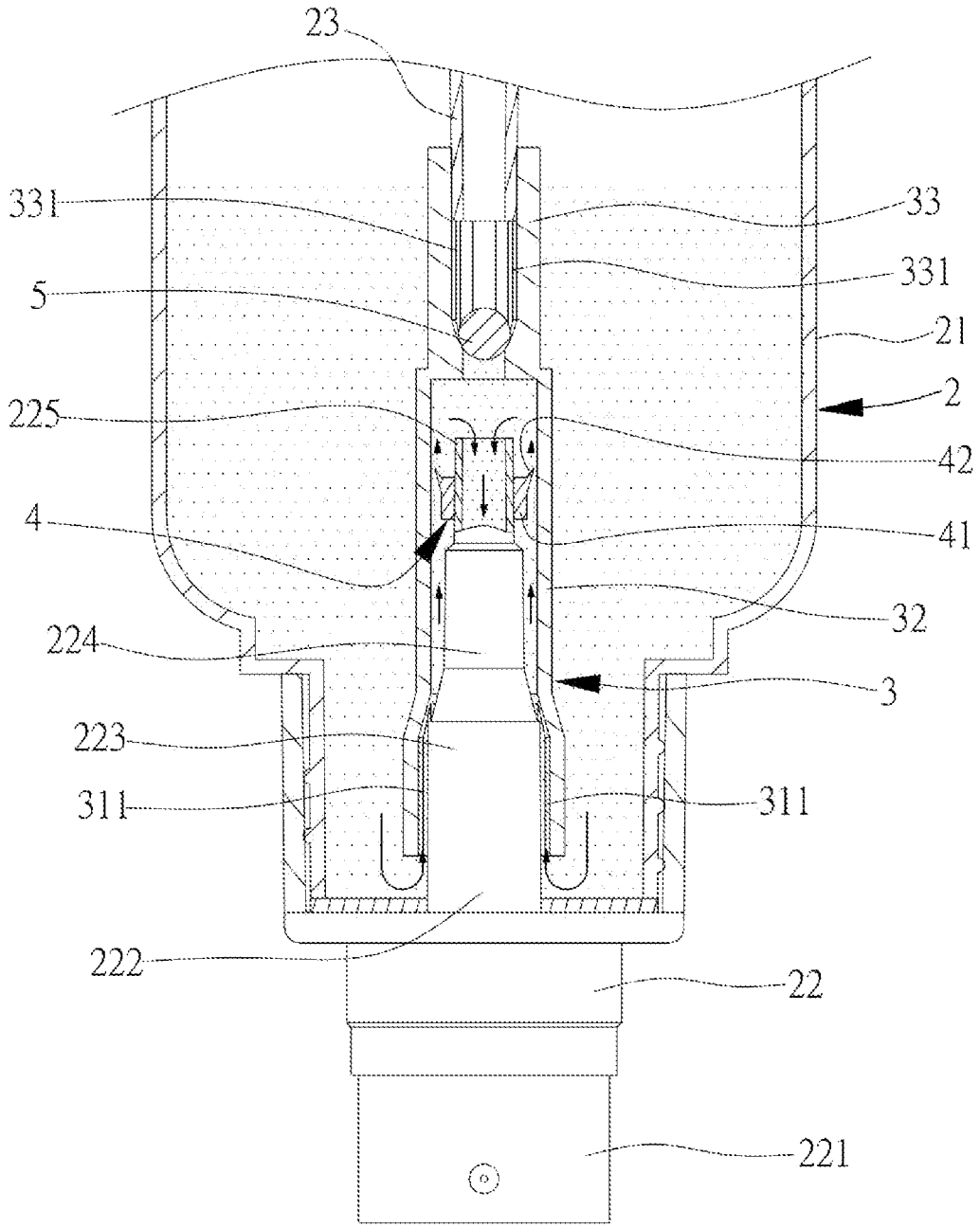
FIG. 8 is a section view of part the assembly of the spray container and the flow guide device in an inverted state according to the above second preferred embodiment of the present invention.

It should be noted that, the type of the check valve 4 shall not be limited to a single design. For example, the check valve 4 may also be implemented as the mode of a second embodiment as illustrated in FIGS. 7 and 8, wherein the check valve 4 similarly has a collar 41 and a ring wing 42 formed by expanding the surround of the collar 41. Therefore, when the spray container 2 is in an inverted state, as illustrated in FIG. 8 and the liquid enters the middle pipe section 32 through the back flow passages 311 and pushes the ring wing 42, the liquid can pass through the check valve 4 to enter the lower assembling section 225, and to be ejected by the nozzle 22 eventually.

Figure 9:
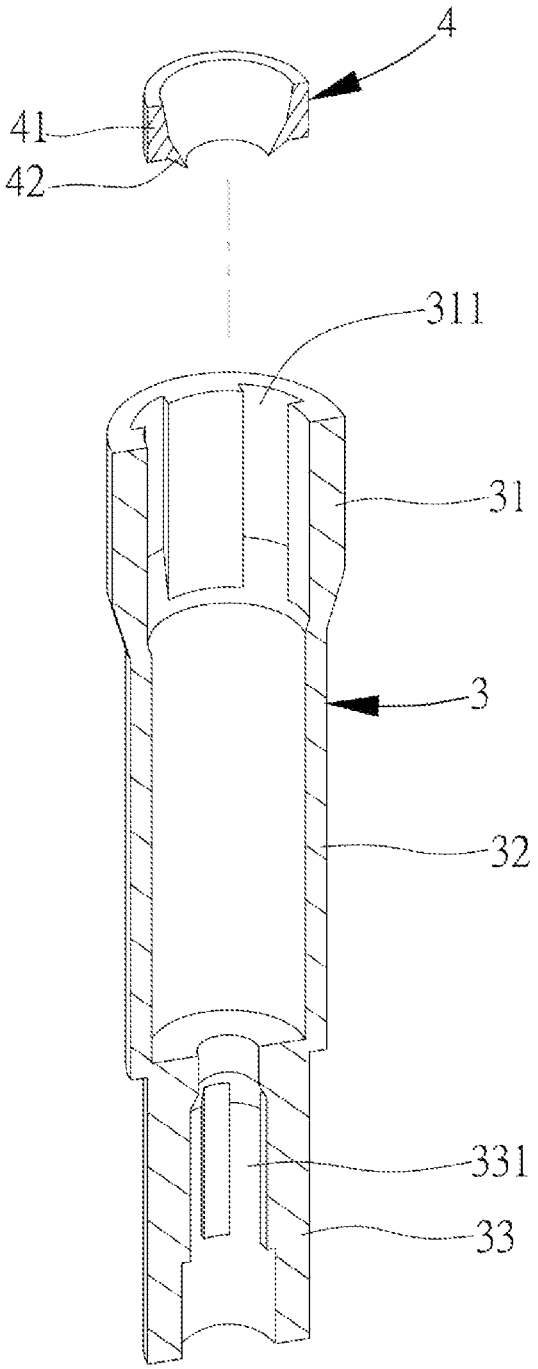
FIG. 9 is a sectional view of part of a check valve and a flow guide pipe of the flow guide device according to a third preferred embodiment of the present invention.
Figure 10:
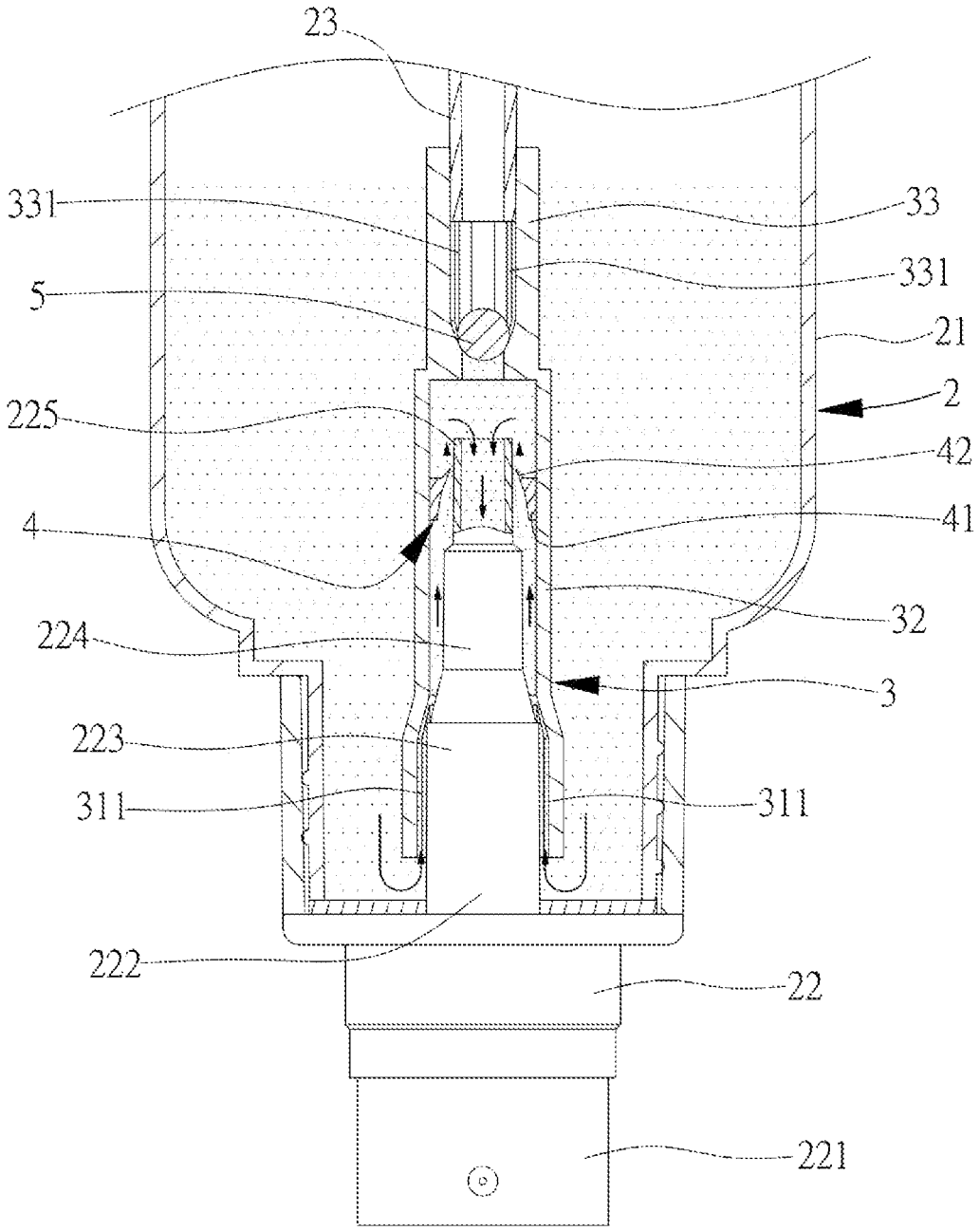
FIG. 10 is a section view of part the assembly of the spray container and the flow guide device in an inverted state according to the above third preferred embodiment of the present invention.

Referring to FIGS. 9 and 10, differences of a third embodiment of the present invention from the above two embodiments include that the check valve 4 has a collar 41 arranged on the inner edge of the middle pipe section 32 and a ring wing 42 inwardly expanded from the surround of the collar 41, wherein the ring wing 42 is in contact with the lower assembling section 225, so as to allow liquid passes through the back flow passages 311 to push the ring wing 42 away from the outer edge of the lower assembling section 225 to pass therethrough to enter the inside of the lower assembling section 225 of the flow guide pipe 222 to be eventually sprayed out from the nozzle 22.

What is claimed is:

1. A flow guide device for a spray container which comprises a bottle adapted for containing liquid, a nozzle configured for assembling on the bottle and a straw, wherein said nozzle comprises a press portion and a flow guide pipe extended downwards from said press portion for extending into said bottle, wherein said flow guide device is assembled and connected between said flow guide pipe and said straw, so as for guiding the liquid in said bottle to be sprayed out from said nozzle, wherein said flow guide device comprises:

a connecting pipe, adapted for connecting said flow guide pipe and said straw, having an upper pipe section, a middle pipe section and a lower pipe section, wherein said upper pipe section is connected with an upper part of said flow guide pipe and has a plurality of back flow passages formed on an inner edge thereof for the liquid in said bottle to flow into said middle pipe section, wherein said lower pipe section is connected with said straw and has a plurality of forward flow passages formed on said inner edge thereof;

a check valve, arranged in said middle pipe section, configured for allowing the liquid entering said middle pipe section from said back flow passages to unidirectionally pass therethrough to enter said flow guide pipe; and a check ball, arranged in said lower pipe section and at said port of said straw, so as for timely preventing the liquid from back flowing into said straw or flowing from said middle pipe section into said lower pipe section, whereby when said spray container is in an upright state and said press portion is pressed, the liquid in said bottle through said straw pushes said check ball away to enter said middle pipe section through said forward flow passages and be guided out from said bottle through said flow guide pipe, and that when said spray container is in an inverted state, the liquid in said bottle enters said middle pipe section through said back flow passages and passes through said check valve to flow through said flow guide pipe to be sprayed out from said nozzle, wherein in the inverted state, said check ball is blocked at an end of said lower pipe section away from said straw so as to prevent the liquid from entering said lower pipe section;

wherein said flow guide pipe has an upper assembling section connected with said press portion, an engaging section extended downwardly from said upper assembling section into said middle pipe section, and a lower assembling section extended downwardly from said engaging section, wherein said upper pipe section is connected with said upper assembling section and said lower assembling section is connected with said check valve, such that said check valve is located between said middle pipe section and said lower assembling section.

2. The flow guide device, as recited in claim 1, wherein said check valve has a collar sleeved on said lower assembling section and a ring wing expandingly formed from surround of said collar, wherein said ring wing is in contact with said middle pipe section, so as for allowing the liquid to pass through said back flow passages to push said ring wing away from said middle pipe section to pass therethrough to enter said lower assembling section of said flow guide pipe.

3. The flow guide device, as recited in claim 1, wherein said check valve has a collar arranged on the inner edge of said middle pipe section and a ring wing inwardly expanded from the surround of said collar, wherein said ring wing is in contact with said lower assembling section, so as for allowing the liquid to pass through said back flow passages to push said ring wing away from the outer edge of said lower assembling section to pass therethrough to enter the inside of said lower assembling section of said flow guide pipe.

* * * * *